US009994371B2

(12) United States Patent
Ware et al.

(10) Patent No.: US 9,994,371 B2
(45) Date of Patent: Jun. 12, 2018

(54) MOLDED FLUOROPOLYMER BREAKSEAL WITH COMPLIANT MATERIAL

(71) Applicant: ADVANCED TECHNOLOGY MATERIALS, INC., Billerica, MA (US)

(72) Inventors: Donald D. Ware, Woodbury, MN (US); Greg Nelson, Minneapolis, MN (US); Amy Koland, Eden Prairie, MN (US); Bruce Musolf, Eagan, MN (US); Michael Allen, Bloomington, MN (US); John Leyes, Chaska, MN (US); James Linder, Victoria, MN (US); Richard L. Wilson, Edina, MN (US); Royce Richter, Eden Prairie, MN (US); Brenna Brosch, Chanhassen, MN (US)

(73) Assignee: Entegris, Inc., Billerica, MA (US)

( * ) Notice: Subject to any disclaimer, the term of this patent is extended or adjusted under 35 U.S.C. 154(b) by 0 days. days.

(21) Appl. No.: 15/328,297

(22) PCT Filed: Jul. 21, 2015

(86) PCT No.: PCT/US2015/041402

§ 371 (c)(1),
(2) Date: Jan. 23, 2017

(87) PCT Pub. No.: WO2016/014585

PCT Pub. Date: Jan. 28, 2016

(65) Prior Publication Data

US 2017/0210519 A1 Jul. 27, 2017

Related U.S. Application Data

(60) Provisional application No. 62/027,486, filed on Jul. 22, 2014, provisional application No. 62/063,772, (Continued)

(51) Int. Cl.
*B65D 47/36* (2006.01)
*B65D 77/06* (2006.01)

(Continued)

(52) U.S. Cl.
CPC ..... *B65D 47/36* (2013.01); *B65D 1/0246* (2013.01); *B65D 41/32* (2013.01); *B65D 47/123* (2013.01);

(Continued)

(58) Field of Classification Search
CPC ..... B60J 10/27; B60J 10/30; B65D 47/36; B65D 47/123; B65D 47/122; B65D 47/12;

(Continued)

(56) References Cited

U.S. PATENT DOCUMENTS 4,696,411 A 9/1987 Graf et al.
5,256,335 A 10/1993 Byrd et al.

(Continued)

FOREIGN PATENT DOCUMENTS

CN 1216694 A 5/1999
CN 101141969 A 3/2008

(Continued)

*Primary Examiner* — Robert J Hicks

(57) ABSTRACT

A breakseal providing desired compliance characteristics for a reliable seal between the fitment of a liquid dispenser and the breakseal. A compliant material is provided on the non-wetted face of the breakseal, enabling compliance of the breakseal on a wetted face for sealing between the breakseal and the mating component. The breakseal may also include raised features on segments that are separated after rupturing that prevent or mitigate scoring of O-ring seals upon probe insertion. A wiping feature that provides redundant sealing between the breakseal and a mating cap or other mating connection may also be incorporated into the breakseal. The breakseal can also include a flat on an outer perimeter that (Continued)

may serve as a gate for injection molding, so that any gate vestige from the molding process will not protrude beyond the outer diameter of the breakseal to cause unwanted interference between the breakseal and the mating connection.

20 Claims, 12 Drawing Sheets

Related U.S. Application Data filed on Oct. 14, 2014, provisional application No. 62/072,206, filed on Oct. 29, 2014, provisional application No. 62/084,203, filed on Nov. 25, 2014, provisional application No. 62/095,947, filed on Dec. 23, 2014.

(51) Int. Cl.

| | |
|---|---|
| ***B65D 47/12*** | (2006.01) |
| ***B65D 51/18*** | (2006.01) |
| ***B65D 1/02*** | (2006.01) |
| ***B65D 41/32*** | (2006.01) |
| ***B65D 53/02*** | (2006.01) |
| ***B65D 81/30*** | (2006.01) |

(52) U.S. Cl.

CPC ..... *B65D 51/18* (2013.01); *B65D 53/02* (2013.01); *B65D 77/06* (2013.01); *B65D 81/30* (2013.01); *B65D 2251/0025* (2013.01); *B65D 2251/0093* (2013.01)

(58) Field of Classification Search

CPC ..... B65D 1/0246; B65D 1/023; B65D 41/34; B65D 41/32; B65D 41/3428; B65D 41/0435; B65D 41/04; B65D 5/748; B65D 51/18; B65D 51/22; B65D 51/222; B65D 51/20; B65D 51/221; B65D 53/02; B65D 77/06; B65D 81/30; B65D 55/024; B65D 17/163; B65D 17/24; B65D 45/32

USPC ..... 215/297, 296, 295, 43, 44, 45, 253, 251, 215/250, 228; 220/278, 277, 258.5, 220/258.4, 258.3, 258.1, 270, 266, 265, 220/257.2, 257.1, 256.1, 304, 288, 319, 220/315, 212.5, 212; 277/917, 641, 643, 277/637, 628

See application file for complete search history.

(56) References Cited

U.S. PATENT DOCUMENTS

| | | | |
|---|---|---|---|
| 5,264,119 | A | 11/1993 | Rollins et al. |
| 5,611,964 | A | 3/1997 | Friend et al. |
| 6,206,240 | B1 | 3/2001 | Osgar et al. |
| 6,221,283 | B1 | 4/2001 | Dharmarajan et al. |
| 6,231,788 | B1 | 5/2001 | Patel |
| 6,248,262 | B1 | 6/2001 | Kubotera et al. |
| 7,354,988 | B2 | 4/2008 | Charati et al. |
| 7,696,274 | B2 | 4/2010 | Terada et al. |
| 7,832,579 | B2 * | 11/2010 | Lohrman ..... B29C 45/16 215/235 |
| 8,002,247 | B2 | 8/2011 | Birtcher et al. |
| 8,328,781 | B2 | 12/2012 | Mizutani et al. |
| 8,585,934 | B2 | 11/2013 | Shah et al. |
| 8,653,177 | B2 | 2/2014 | Nagao et al. |
| 8,858,593 | B2 | 10/2014 | Kerber |
| 2003/0096104 | A1 | 5/2003 | Tobita et al. |
| 2004/0045965 | A1 | 3/2004 | Dwinell et al. |
| 2004/0232152 | A1 | 11/2004 | Schimmelmann et al. |
| 2004/0251634 | A1 | 12/2004 | Shimazu et al. |
| 2005/0030026 | A1 | 2/2005 | Pines et al. |
| 2005/0186378 | A1 | 8/2005 | Bhatt |
| 2006/0280938 | A1 | 12/2006 | Atkinson |
| 2008/0292534 | A1 | 11/2008 | Richardson et al. |
| 2010/0003438 | A1 | 1/2010 | Bryant et al. |
| 2010/0078194 | A1 | 4/2010 | Bhatt et al. |
| 2010/0311866 | A1 | 12/2010 | Huang et al. |
| 2011/0123735 | A1 | 5/2011 | Shah et al. |
| 2011/0186775 | A1 | 8/2011 | Shah et al. |
| 2011/0297892 | A1 | 12/2011 | Shah et al. |
| 2012/0000691 | A1 | 1/2012 | Shah et al. |
| 2012/0067883 | A1 | 3/2012 | Montuori et al. |
| 2012/0177906 | A1 | 7/2012 | Sousa et al. |
| 2012/0241686 | A1 | 9/2012 | Bastiaens et al. |
| 2013/0203928 | A1 | 8/2013 | Hocke et al. |
| 2013/0224470 | A1 | 8/2013 | Vautard et al. |
| 2013/0291441 | A1 | 11/2013 | Rho |
| 2014/0264181 | A1 | 9/2014 | Shin et al. |
| 2014/0316063 | A1 | 10/2014 | Hochstetter et al. |
| 2014/0319176 | A1 | 10/2014 | Dolos |
| 2014/0350525 | A1 | 11/2014 | Robinson et al. |
| 2014/0374416 | A1 | 12/2014 | Tom et al. |

FOREIGN PATENT DOCUMENTS

| | | | |
|---|---|---|---|
| CN | 201460804 | U | 5/2010 |
| CN | 201460805 | U | 5/2010 |
| CN | 101784307 | A | 7/2010 |
| CN | 201530357 | U | 7/2010 |
| CN | 201535976 | U | 7/2010 |
| CN | 101808678 | A | 8/2010 |
| CN | 102418471 | A | 4/2012 |
| CN | 202453095 | U | 9/2012 |
| EP | 1 419 753 | A1 | 5/2004 |
| EP | 2 759 563 | A2 | 7/2014 |
| JP | 5-238267 | A | 9/1993 |
| JP | 2006-089080 | A | 4/2006 |
| KR | 10-2004-0042533 | A | 5/2004 |
| KR | 20-0452250 | Y1 | 2/2011 |
| TW | 200934548 | A | 8/2009 |
| TW | 201343218 | A | 11/2013 |
| WO | 90/02676 | A1 | 3/1990 |
| WO | 2008/091438 | A1 | 7/2008 |
| WO | 2012/051093 | A2 | 4/2012 |
| WO | 2014/066723 | A1 | 5/2014 |
| WO | 2016/014585 | A1 | 1/2016 |

* cited by examiner

MOLDED FLUOROPOLYMER BREAKSEAL WITH COMPLIANT MATERIAL

RELATED APPLICATIONS

This application is a National Phase entry of PCT Application No. PCT/US2015/041402 filed Jul. 21, 2015, which claims the benefit of: U.S. Provisional Patent Application No. 62/027,486, filed Jul. 22, 2014; U.S. Provisional Patent Application No. 62/063,772, filed Oct. 14, 2014; U.S. Provisional Patent Application No. 62/072,206, filed Oct. 29, 2014; U.S. Provisional Patent Application No. 62/084,203, filed Nov. 25, 2014; and U.S. Provisional Patent Application No. 62/095,947, filed Dec. 23, 2014. The disclosures of these related applications are hereby incorporated by reference herein in their entirety.

FIELD OF THE DISCLOSURE

The present disclosure is directed generally to control ruptured membranes and more particularly to breakseals for shipping and dispensing systems.

BACKGROUND

Container systems are used in many industries for storing, shipping and/or dispensing materials of a variety of viscosities. For example, numerous manufacturing processes require the use of ultrapure liquids, such as acids, solvents, bases, photoresists, slurries, cleaning formulations, dopants, inorganic, organic, metalorganic and biological solutions, pharmaceuticals, and radioactive chemicals. Such applications require that the number and size of particles in the ultrapure liquids be minimized. In particular, because ultrapure liquids are used in many aspects of the microelectronic manufacturing process, semiconductor manufacturers have established strict particle concentration specifications for process chemicals and chemical-handling equipment. Such specifications are needed because, should the liquids used during the manufacturing process contain sufficient levels of particles or bubbles, the particles or bubbles may be deposited on solid surfaces of the silicon. This can, in turn, lead to product failure or reduced quality and reliability. In some cases the contents of a container may be expensive and, as such, defects in an end process, such as a semiconductor process, resulting from contamination of the liquid stored in the container system can have significant adverse and costly consequences.

To help protect the contents of such containers, often, at a mouth or other opening to such containers, a protective seal may be provided to, for example, seal in the contents of the container and prevent contaminants or light from being introduced into the container and thus into the material stored therein. The seal can be a rupturable seal or membrane, or what is commonly referred to as a "breakseal." A breakseal is typically designed such that the breakseal does not rupture or break by impact or pressures commonly occurring, for example, during transport and handling of the container, but easily ruptures when punctured by a force applied, for example, by a dispense system connector for dispensing the contents of the container.

Breakseals also protect operating personnel. A tear tab is typically removed with the breakseal in place. After removal of the tear tab, the breakseal is ruptured with a probe for coupling to a bottle and tool. The breakseal prevents caustic liquids from entering the breakseal cavity so as not to harm or injure operating personnel who remove the tear tab. The breakseal also protects operating personnel from spilling, splashes, and vapor during the coupling with the tool.

Certain deficiencies in breakseals of the prior art have been discovered. Such deficiencies include "shedding" of foam utilized in two-layered structures. In two-layered breakseal structures, a first layer of laminated low-density polyethylene (LDPE) foam and a second layer of polytetrafluoroethylene (PTFE) film are bonded together using an adhesive. In a central portion of the breakseal, tear lines or score lines extend radially from the center, such that when a dispense system connector is pressed against the breakseal for connection with the container, the tear lines permit the breakseal to tear. The LDPE foam and use of adhesives in such breakseals can lead to undesirable contamination because of "shedding" of the foam (i.e., generation of particulates when subject to friction). Downstream defects can thereby result in certain manufacturing processes. Furthermore, the adhesive material used to bond the two layers may be introduced into the material stored within the storage container, thereby reducing the purity of the material and causing problems in downstream processes.

There is a need for a breakseals which reduce and/or minimize contamination of contents in a container system. Particularly, there is a need for breakseals and methods of making the breakseals for use in shipping and dispensing systems, such as those typically used for the storage, transport, and dispense of photosensitive reagents or other ultrapure chemicals used in the semiconductor manufacturing industry. The present disclosure relates to breakseal embodiments which can overcome the disadvantages of traditional breakseals, and describes breakseal embodiments that can be produced with relatively low cost and by processes that are simpler than traditional breakseals and/or that enhance prevention of contamination to the contents of a container system.

SUMMARY

Various embodiments of the present disclosure include a breakseal that provides desired compliance characteristics to provide a reliable seal between the fitment of a liquid dispenser and the breakseal. In certain embodiments, a breakseal is disclosed that includes a wiping feature to provide redundant sealing between the breakseal and a mating cap or other mating connection.

In various embodiments, a breakseal is disclosed that includes a flexible centering structure for ease of installation. Also, various embodiments prevent the sharp edges that can result from rupturing the breakseal from contacting the soft, fragile O-ring material of the probe as the O-ring passes through the ruptured breakseal, thereby preventing the sharp edges from damaging the O-ring and causing leaks. In various embodiments, the breakseal includes a flat on an outer perimeter that can serve as a gate for injection molding, so that any gate vestige from the molding process will not protrude beyond the outer diameter of the breakseal to cause unwanted interference or misalignment between the breakseal and the mating connection. Also, by this arrangement, the gate vestige is outside the breakseal, so that any shedding from the vestige is unlikely to find its way into the liquid and process stream.

Korean patent 20-0452250 to ERE Materials, Inc. ("KR '250"), titled "One Layer Break Seal," which is herein incorporated by reference in its entirety except for the claims and express definitions contained therein, describes a breakseal configuration. In general, the breakseal of the KR '250 has a circular plate shape made of a single layer of injection molded low-density polyethylene (LDPE), as depicted and discussed at FIG. 1 below. The KR '250 asserts that such a breakseal eliminates drawbacks of the traditional breakseal described in the Background.

However, such a breakseal is not without faults, including susceptibility to sink. "Sink" occurs when material shrinks away from walls of a mold cavity during the cure process, and is often associated with the thicker sections of a mold. Sink adversely affects the structural integrity of the breakseal, which in turn adversely affects the ability of the molded products to function as a protective seal. Furthermore, the breakseal of the KR '250 can be more difficult and may take longer to manufacture than other prior art breakseals, each of which drives up manufacturing costs.

Structurally, to address one or more of these shortcomings, various embodiments of an improved breakseal are disclosed herein that include an outer rim portion and a central seal portion, both concentric about a central axis, the outer rim portion defining an outer edge. An inner circular rib may be disposed at a junction between the outer rim portion and the central seal portion, the inner circular rib being continuous and extending from a non-wetted face of the breakseal in a first direction parallel to the central axis. The inner circular rib may also be configured to include an interior surface facing the central axis and an exterior surface facing away from the central axis, the exterior surface of the circular rib including a tapered portion that defines a predetermined angle relative to the central axis. In one embodiment, a plurality of score grooves are formed to a depth within the thickness of the central seal portion, such that the central seal portion is configured to rupture generally uniformly on application of a force or pressure thereon that is above a predetermined threshold.

In various embodiments, a molded breakseal is disclosed, comprising an outer rim portion and a central seal portion, both concentric about a central axis, the outer rim portion defining an outer edge. An inner circular rib may be disposed at a junction between the outer rim portion and the central seal portion, the inner circular rib being continuous and extending from a non-wetted face of the breakseal in a first direction parallel to the central axis. In some embodiments, an outer circular rib is disposed between the inner circular rib and the outer edge of the outer rim portion, the outer circular rib being continuous and extending from the non-wetted face of the breakseal in the first direction parallel to the central axis. The inner circular rib, the outer circular rib, and the outer rim portion cooperate to define a channel, the outer rim portion further defining a flexible centering structure that extends radially beyond the outer circular rib to the outer edge. Also, a plurality of score grooves are formed on the central seal portion. In one embodiment, the plurality of score grooves are formed on the non-wetted face of the breakseal.

Some embodiments of the breakseal can further comprise an outer rib extending from the outer edge of the breakseal in a first direction parallel to the central axis, the outer rib being continuous and defining a flat over a portion thereof. In some embodiments, the breakseal further comprises at least one circular intermediate rib concentric about the central axis and disposed radially outward from the inner circular rib, the at least one circular intermediate rib extending from the non-wetted face of the breakseal in a first direction parallel to the central axis. The inner circular rib can extend further in the first direction parallel to the central axis than the at least one circular intermediate rib. The at least one circular intermediate rib can comprise a first intermediate rib and a second intermediate rib, the second intermediate rib being disposed radially outward from the first intermediate rib to define a continuous channel therebetween on the non-wetted face.

In various embodiments, a compliant material is disposed in the continuous channel. The compliant material can be an O-ring, and can be selected from the group consisting of EPDM, CHEMRAZ®, and KALREZ®. CHEMRAZ® is a registered trademark of Greene, Tweed Technologies, Inc., of Wilmington, Del., U.S.A. KALREZ® is a registered trademark of DuPont Performance Elastomers, LLC of Wilmington, Del., U.S.A. In one embodiment, the breakseal is formed from perfluoroalkoxy (PFA). In some embodiments, an alternating copolymer of tetrafluoroethylene and propylene (TFE/P) is utilized, such as AFLAS®, for the compliant material. AFLAS® is a registered trademark of Asahi Glass Co., Ltd. of Tokyo, Japan In some embodiments, the breakseal can further comprise an alignment feature depending from a wetted face of the breakseal. The alignment feature can depend from the outer rim portion of the breakseal. In one embodiment, the alignment feature includes an inner surface that faces the central axis, the inner surface including a tapered portion that tapers away from said central axis in a direction away from the wetted face. Optionally, or in addition, the inner surface can be dimensioned for an interference fit with a fitment.

In various embodiments, the breakseal is injection molded. In one embodiment, the breakseal is formed from perfluoroalkoxy (PFA). The central seal portion can be configured to rupture generally uniformly on application of a force of between about 15 Newtons (N) and about 70 N. In one embodiment, the plurality of score grooves intersect at the central axis. The plurality of score grooves can also be formed the non-wetted face of the breakseal.

In some embodiments, the flexible centering structure defines a plurality of relief slots, each slot extending radially inward from the outer edge. The breakseal can also comprise a plurality of raised features on the non-wetted face of the breakseal proximate the score grooves. The plurality of score grooves can intersect at the central axis to define a plurality of pie-shaped segments, each pie-shaped segment defining an apex, and wherein each of the plurality of raised features is disposed on a corresponding one of the plurality of pie-shaped segments proximate the apex.

In various embodiments of the disclosure, a container system implementing a molded breakseal as described above is disclosed that comprises a fitment including a body portion defining an access port and having a continuous raised face concentric about a port axis of the access port. The molded breakseal is in contact with the continuous raised face of the fitment, the central axis of the molded breakseal being in substantial alignment with the port axis of the access port. The raised face defines a contact radius that contacts a wetted face of the molded breakseal in alignment with the continuous annular channel. A compliant material disposed in the channel of the molded breakseal. In some embodiments, a liner is attached to the fitment. The liner may be configured to contain a photoresist. In certain embodiments, the container system further comprises an overpack including a neck portion defining an opening, the fitment being disposed in the neck portion. The container system may further comprise a cap detachably coupled to the neck portion, the cap securing the molded breakseal.

In some embodiments, the outer rim portion of the molded breakseal defines a flexible centering structure that extends radially beyond the outer circular rib to the outer edge. The cap may further define a recess having an outer wall, the outer wall being sized to accommodate the outer rim portion of the flexible centering structure with a light interference fit.

In various embodiments of the disclosure, a method for protecting a probe during insertion through a breakseal is disclosed, the method including providing a breakseal including a central seal portion; providing operating instructions on a tangible medium, wherein the instructions comprise exerting a force on the breakseal with the probe that causes the breakseal to rupture along the plurality of score grooves to define a plurality of exposed edges of the pie-shaped segments; and pushing the probe through the breakseal after the step of exerting, causing the probe to slide on the plurality of raised feature, thereby preventing contact of the exposed edges with the probe. The central seal portion defines a plurality of score grooves that intersect at a central axis of the central seal portion to define a plurality of pie-shaped segments, each pie-shaped segment defining an apex, the breakseal including a plurality of raised features disposed on a non-wetted face of the breakseal, each of the plurality of raised features being disposed on a corresponding one of the plurality of pie-shaped segments proximate the apex.

DETAILED DESCRIPTION

Figure 1:
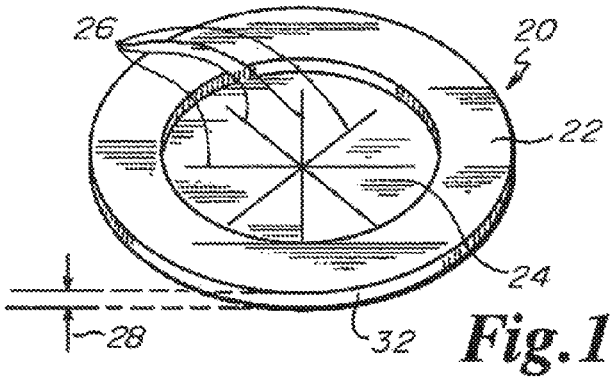
Fig.1 (PRIOR ART)
FIG. 1 is a perspective view of a conventional breakseal.

Referring to FIG. 1, a conventional breakseal 20 is depicted. The conventional breakseal 20 includes a thick outer ring portion 22 surrounding a thin central portion 24, the thin central portion 24 including score lines 26. A thickness 28 of the outer ring portion 22 provides stoutness that renders the outer ring portion 22 rigid. The thickness 28 also defines an outer face 32 of substantially the same height as the thickness 28.

The geometry of the conventional breakseal 20 requires a degree of care during alignment with a cap (not depicted) during assembly of the breakseal 20 into a cap system. The outer face 32 creates essentially a bearing surface that rides within the cap. If sufficiently misaligned with receiving surfaces within the cap, the conventional breakseal 20 can, in some instances, become canted within the cap. The canting effectively creates an interference fit between the diagonal dimension of the conventional breakseal 20 and the receiving surfaces of the cap. Furthermore, if the outer ring portion 22 is of a stout material, the outer ring portion 22 might not, in some instances, yield to the interference forces. Thus, for many materials, canting problems may be related to the thickness and stoutness of the outer ring portion.

Figure 2A:
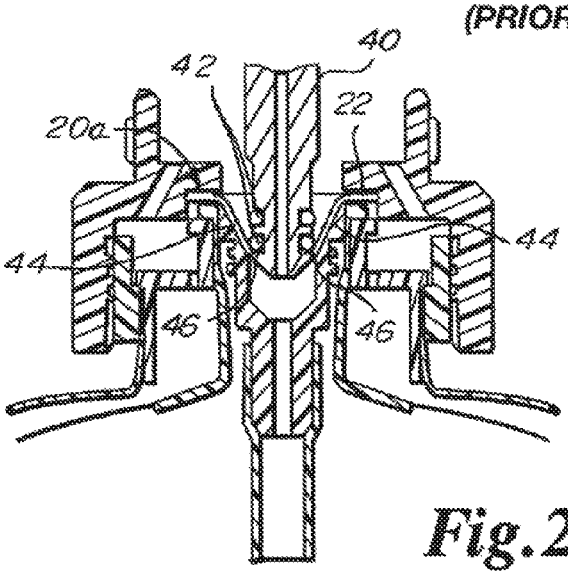
Fig.2A (PRIOR ART)
FIGS. 2A and 2B are sectional views of the conventional breakseal of FIG. 1 in operation.
Figure 2B:
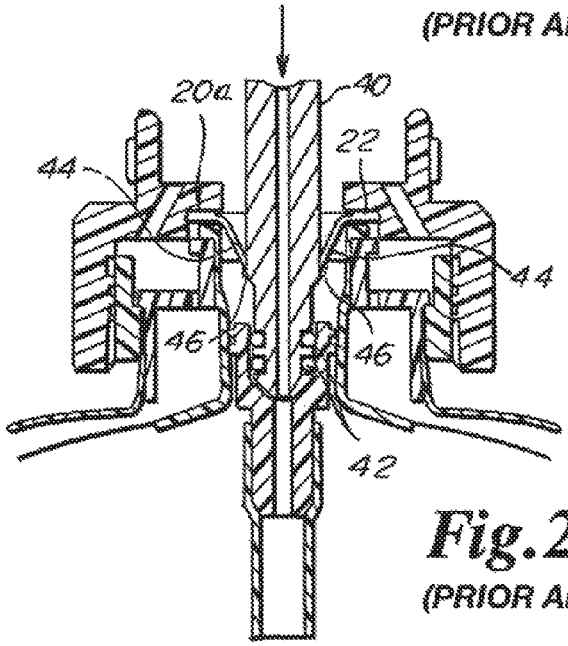
Fig.2B (PRIOR ART)

Referring to FIGS. 2A and 2B, insertion of a probe 40 through a ruptured conventional breakseal 20*a* is depicted. The depicted probe 40 includes O-ring seals 42, as is customary for many dispensing systems. The rupturing of the conventional breakseal 20 causes the score lines 26 (FIG. 1) to tear, defining edges 44 and points 46 within the ruptured conventional breakseal 20*a*. For some materials, these edges 44 and points 46 can be quite sharp. The resilience of the material can also cause the edges 44 and points 46 to ride on and exert a force against the O-ring seals 42 as they pass through the ruptured conventional breakseal 20*a*. The force can cause the sharp edges 44 and points 46 to score the O-ring seals 42, causing leaks in the dispensing system during operation.

The following embodiments of the present disclosure are directed to addressing these issues, in addition to the other issued discussed in the Background of this application.

Figure 3:
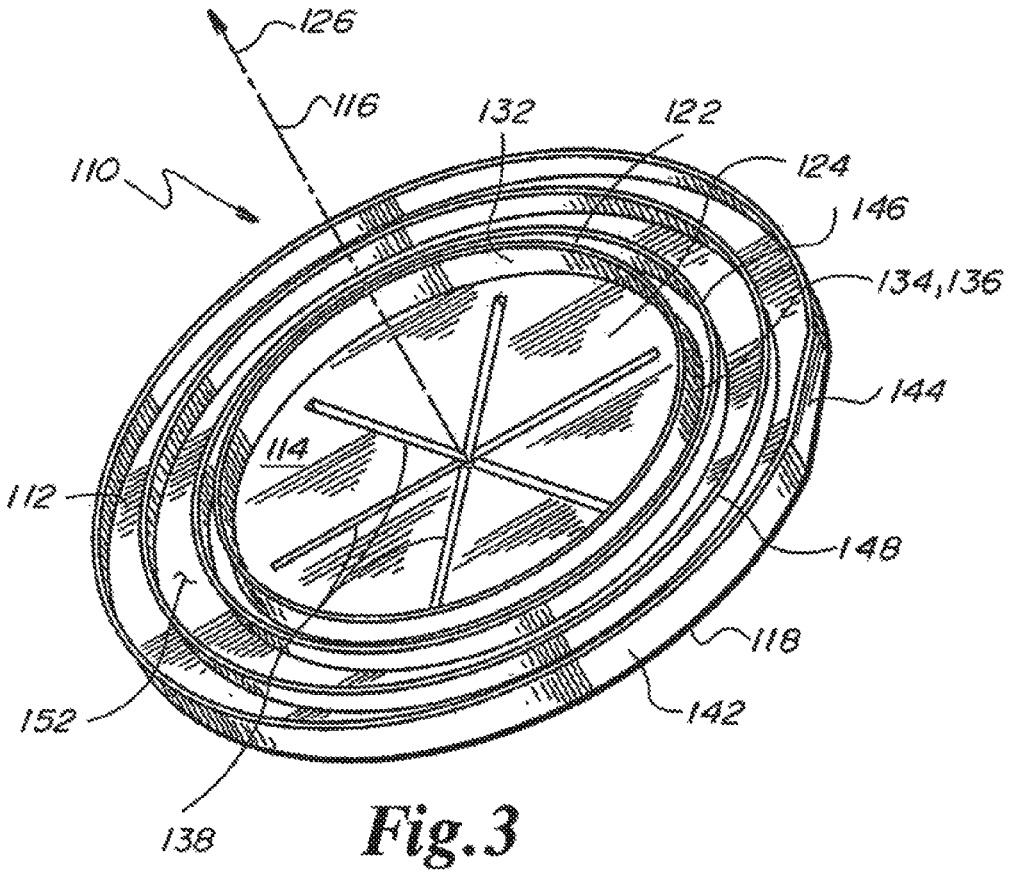
FIG. 3 is a perspective view of a breakseal in an embodiment of the disclosure.
Figure 4:
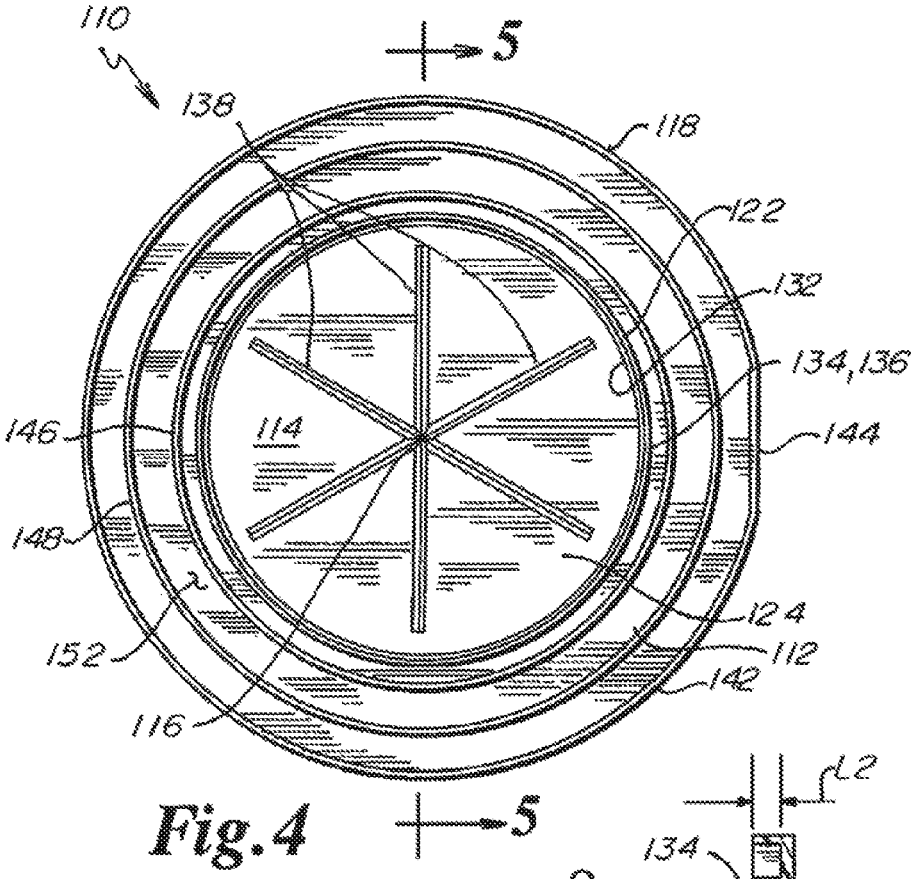
FIG. 4 is a plan view of the breakseal of FIG. 3.
Figure 5:
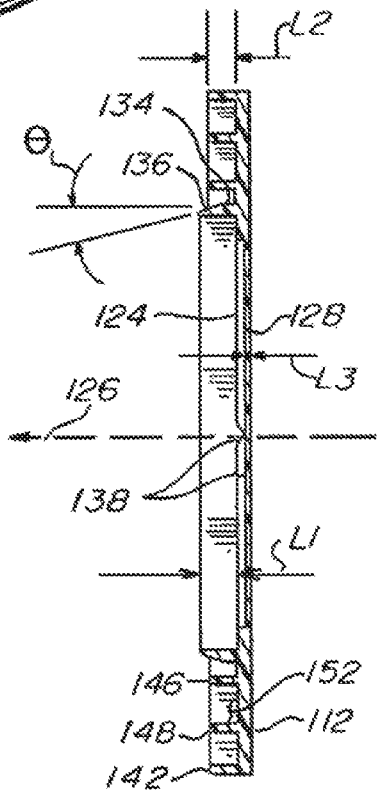
FIG. 5 is a sectional view of the breakseal of FIG. 4.

Referring to FIGS. 3 through 5, a breakseal 110 is depicted in an embodiment of the disclosure. The breakseal 110 includes an outer rim portion 112 and a diaphragm or central seal portion 114, both concentric about a central axis 116. The outer rim portion 112 defines an outer edge 118. An inner circular rib 122 is disposed at a junction between the outer rim portion 112 and the central seal portion 114. The inner circular rib 122 extends from a non-wetted face 124 of the breakseal 110 in a first direction 126 that is parallel to the central axis 116. The breakseal 110 further includes a wetted face 128 opposite the non-wetted face 124. In some embodiments, the inner circular rib 122 is continuous.

For purposes of this application, a "wetted face" is the entirety of the face of a breakseal that includes a portion that may be wetted by a liquid contained in a container; that is, the "wetted face" is not limited to the portion of the breakseal that is actually wetted by the liquid contents of the container, but includes the entire face that includes the wetted portion. A "non-wetted face" is the face of the breakseal that is opposite the wetted face.

The inner circular rib 122 includes an interior surface 132 that faces the central axis 116 and an exterior surface 134 that faces away from the central axis 116. In one or more embodiments, the exterior surface 134 of the inner circular rib 122 includes a tapered portion 136 that defines a predetermined angle 9 relative to the central axis 116. In one embodiment, the breakseal 110 is a molded component formed from perfluoroalkoxy (PFA). The various components of the breakseal 110 may be a single, unitary component (e.g., integrally formed in a molding process).

In various embodiments, a plurality of score lines or score grooves 138 are formed on the non-wetted face 124 to a depth that extends into the central seal portion 114. Each score groove 138 penetrates the thickness of the central seal portion 114 to define a minimum thickness L3 of the central seal portion 114, the minimum thickness L3 being defined between the depth extremity of the score groove 138 and the opposing face (e.g., the wetted face 128 of FIG. 5). The minimum thickness L3 of the central seal portion 114 is configured to rupture generally uniformly along the score grooves 138 on application of a force or pressure thereon that is above a predetermined threshold. In some embodiments, the plurality of score grooves 138 intersect at the central axis 116.

In various embodiments, the central seal portion 114 has a nominal thickness in the range of 0.5 mm to 1.0 mm inclusive. (Herein, a range that is said to be "inclusive" includes the end point values of the range.) In some embodiments, the nominal thickness of the central seal portion 114 is in the range of 0.5 mm to 0.8 mm inclusive; in some embodiments, the nominal thickness of the central seal portion 114 is in the range of 0.55 mm to 0.7 mm inclusive; in some embodiments, the nominal thickness of the central seal portion 114 is in the range of 0.58 mm to 0.66 mm inclusive.

In some embodiments, the score grooves 138 are formed to define the minimum thickness L3 in the range of 0.1 mm to 0.7 mm inclusive; in some embodiments, the score grooves 138 are formed to define the minimum thickness L3 in the range of 0.1 mm to 0.4 mm inclusive; in some embodiments, the score grooves 138 are formed to define the minimum thickness L3 in the range of 0.12 mm to 0.25 mm inclusive. In some embodiments, the central seal portion 114 is configured to rupture generally uniformly on application of a force thereon in the range of 15 Newtons (N) to 70 N inclusive.

The breakseal 110 may further comprise an outer rib 142 extending from the outer edge 118 of the breakseal 110 in the first direction 126 parallel to the central axis 116, the outer rib 142 being continuous and defining a flat 144 over a portion thereof. In some embodiments, the breakseal 110 further comprises circular intermediate ribs 146 and 148 concentric about the central axis 116 and disposed radially outward from the inner circular rib 122. The circular intermediate ribs 146 and 148 extend from the non-wetted face 124 of the breakseal 110 in the first direction 126 parallel to the central axis 116 to define a continuous annular channel 152 therebetween on the non-wetted face 124. In one embodiment, the inner circular rib 122 extends further in the first direction 126 than the circular intermediate ribs 146 and 148 and/or the outer rib 142. That is, in such embodiment, the inner circular rib 122 defines an axial length L1 that is greater than the axial lengths L2 of the circular intermediate ribs 146, 148 and/or the outer rib 142, where "axial length" is defined as a dimension that is parallel to the central axis 116.

Figure 7:
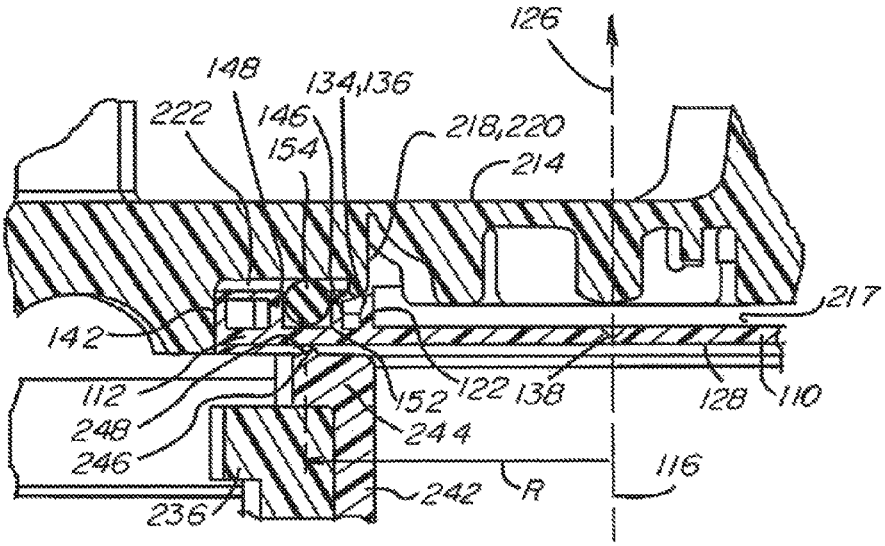
FIG. 7 is an enlarged, partial sectional view of the cap and bottle assembly of FIG. 6.

In various embodiments, the continuous annular channel 152 is configured to accommodate a compliant material 154 (FIG. 7). The compliant material 154 includes a non-shedding material (i.e., a material that resists particle generation under friction) that is compatible with the liquids being dispensed through the breakseal 110. In various embodiments, such compatible, non-shedding materials include ethylene propylene diene monomer (EPDM) or a perfluoroelastomer polymer such as CHEMRAZ® or KALREZ®. In various embodiments, the compliant material 154 is in the form of a compliant member, such as an O-ring (FIG. 7) or gasket. In some embodiments, the compliant material 154 may be composed of a loose material packed into the channel 152, such as a packing. Various packing materials are be self-adhering, and therefore resistant to shedding.

Figure 6:
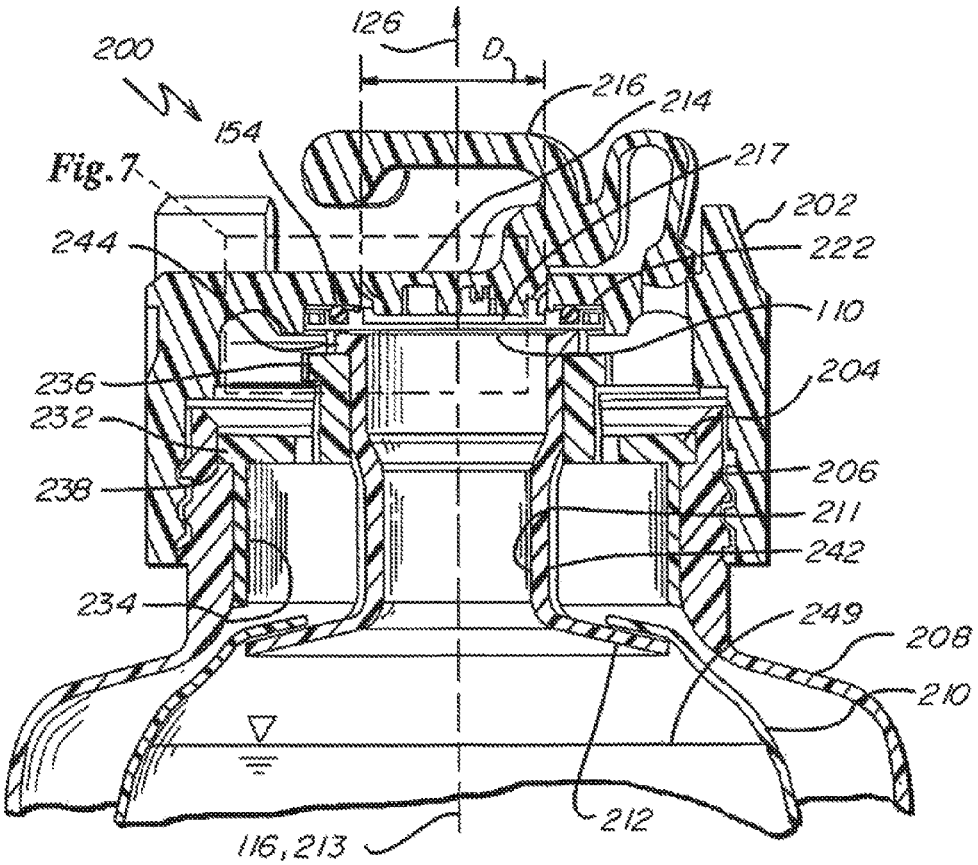
FIG. 6 is a partial sectional view of a cap and bag-in-bottle assembly utilizing the breakseal of FIG. 3 in an embodiment of the disclosure.

Referring to FIGS. 6 and 7, a cap assembly 200 utilizing the breakseal 110 is depicted in an embodiment of the disclosure. The cap assembly 200 includes a cap 202 and may include a retainer 204 mounted to a neck portion 206 of an overpack 208, such as a bottle or canister. In some embodiments, a fitment 212 that provides access to, for example, a liner 210, is disposed in the retainer 204 and captured by the cap 202. The fitment 212 defines an access port 211 concentric about a port axis 213. In assembly, the central axis 116 of the breakseal and the port axis 213 of the fitment 212 are in substantial alignment, and the cap 202, retainer 204, neck portion 206, and fitment 212 are substantially concentric about the axes 116 and 213.

In some embodiments, the cap 202 includes a tear tab 214 and handle 216, the tear tab 214 and breakseal 110 defining tear tab cavity 217 therebetween. The cap 202 may further define a throat portion 218 having an inner wall 220 that defines an inner diameter D, the throat portion 218 being blocked off by the tear tab 214. The cap 202 may also define a recess 222 that encircles the throat portion 218, the recess 222 being sized to accommodate the outer rim portion 112 of the breakseal 110. In one embodiment, the recess 222 is an annular recess.

The retainer 204 may include a flange portion 232 having a skirt portion 234 that extends into the neck portion 206 of the overpack 208, and a collar portion 236 that extends out of the neck portion 206. The flange portion 232 extends radially from the central axis 116 beyond the skirt portion 234 and rests on an internal shoulder 238 formed in the neck portion 206 of the overpack 208.

The fitment 212 includes a body portion 242 and may include a flange portion 244 that extends radially outward from the body portion 242. The body portion 242 is disposed within and extends through the collar portion 236, with the flange portion 244 of the fitment 212 being engaged with the collar portion 236 and being situated between the collar portion 236 and the cap 202. In one embodiment, the flange portion 244 of the fitment 212 includes a continuous raised face 246 that extends from the body portion 242 (e.g., the flange portion 244) in the first direction 126 parallel to the central axis 116. In the depicted embodiment, the raised face 246 defines a radiused profile 248. In one embodiment, the raised face 246 is centered at a contact radius R from the central axis 116 that is located between the circular intermediate ribs 146 and 148; that is, the raised face 246 contacts the wetted face 128 of the breakseal 110 at a radius that is in alignment with the continuous annular channel 152, such that the radiused face 246 is in contact with the segment of the outer rim portion 112 of the breakseal 110 that defines the annular channel 152. Other profiles besides the radiused profile 248 may be implemented, such as polygonal (e.g., triangular) profiles.

In assembly, the retainer 204 and fitment 212 are disposed in the neck portion 206 of the overpack 208, with the flange portion 232 of the retainer 204 seated on the internal shoulder 238 of the neck portion 206. The compliant material 154 is loaded into the continuous annular channel 152 of the breakseal 110, and the loaded breakseal 110 is disposed in the cap 202 so that the outer rim portion 112 is coupled with the recess 222. After implementation of a supply process (e.g., filling of the liner 210 attached to the fitment 212 with a liquid 249), the cap 202, with the breakseal 110 installed therein, is coupled to the neck portion 206 of the overpack 208 so that the wetted face 128 of the breakseal 110 is brought into contact with the raised face 246 of the fitment 212. The cap 202 is then secured to the neck portion 206 to exert a compression force on the breakseal 110 via the complaint material 154. In one embodiment, securing of the cap 202 to the neck portion 206 is accomplished by threaded engagement, and the compression force is accomplished by rotating (torquing) the cap 202 onto the neck portion 206.

In various embodiments, the tapered portion 136 of the exterior surface 134 of the inner circular rib 122 is dimensioned to engage the inner wall 220 of the throat portion 218. As the breakseal 110 is compressed by the cap 202, an interference fit develops between the tapered portion 136 of the inner circular rib 122 the inner wall 220 of the throat portion 218.

Functionally, the raised face 246 acts as a stress concentrator when breakseal 110 is compressed thereon that acts to deform the breakseal 110 about the radiused profile 248 of the raised face 246. The compliance of the compliant material 154 enables the outer rim portion 112 to deflect and conform to the shape of the raised face 246 while directly increasing a compression force between the breakseal 110 and the raised face 246, thereby affecting a seal between the breakseal 110 and the fitment 212. Also, by this arrangement, the compliant material 154 does not make contact with the contained liquid 249, and thus need not be compatible with the liquid 249.

In various embodiments, the tapered portion 136 of the inner circular rib 122 acts as a wiping feature to provide an additional liquid seal between the breakseal 110 and tear tab cavity 217. This wiping feature prevents liquid from entering into the tear tab cavity 217 in the event liquid breaches the seal at the interface between the breakseal 110 and the raised face 246 of the fitment 212.

In various embodiments, the wiping feature protects the compliant material 154 from being exposed to chemical and prevent the subsequently contaminated chemical from entering the bottle (FIGS. 3 through 5). That is, in some instances, the probe that is inserted through the breakseal is still wet with chemical from the previous bottle. The wiping feature prevents the chemical from making contact with the breakseal and then running into the container once the breakseal is ruptured.

The flat 144 provides an area for a gate for injection molding. At the flat 144, any gate vestige from the molding process will not protrude beyond the outer diameter of the breakseal 110, and therefore does not cause unwanted interference or misalignment between the breakseal 110 and the cap 202.

Figure 8:
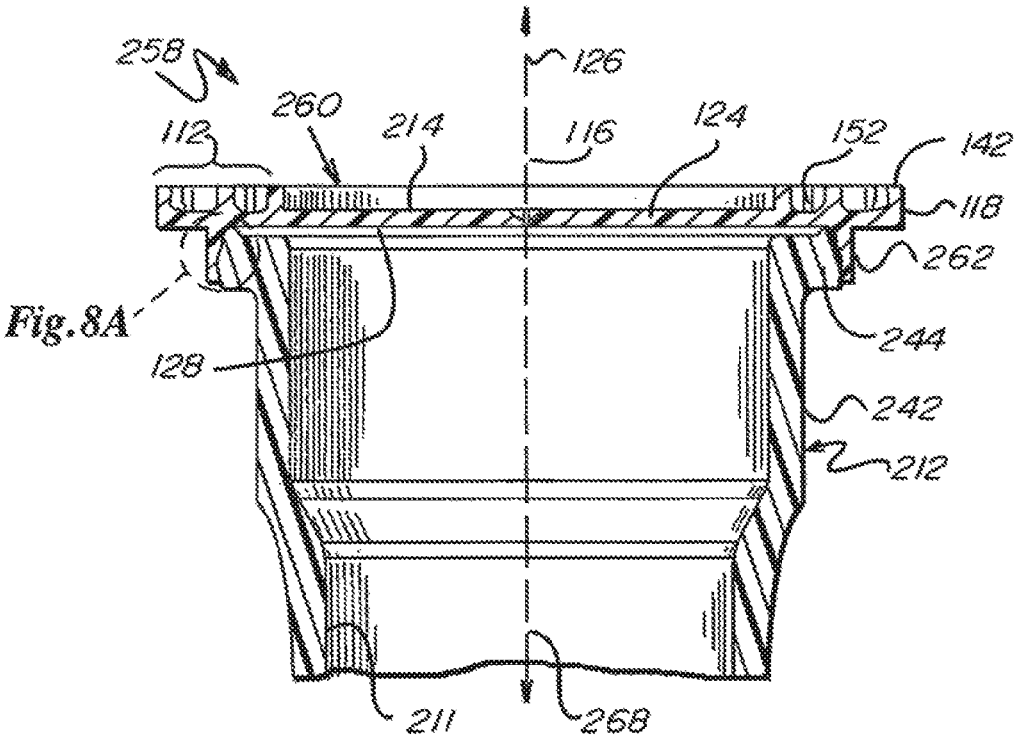
FIG. 8 is a sectional view of a breakseal in sub-assembly with a fitment in an embodiment of the disclosure.
Figure 8A:
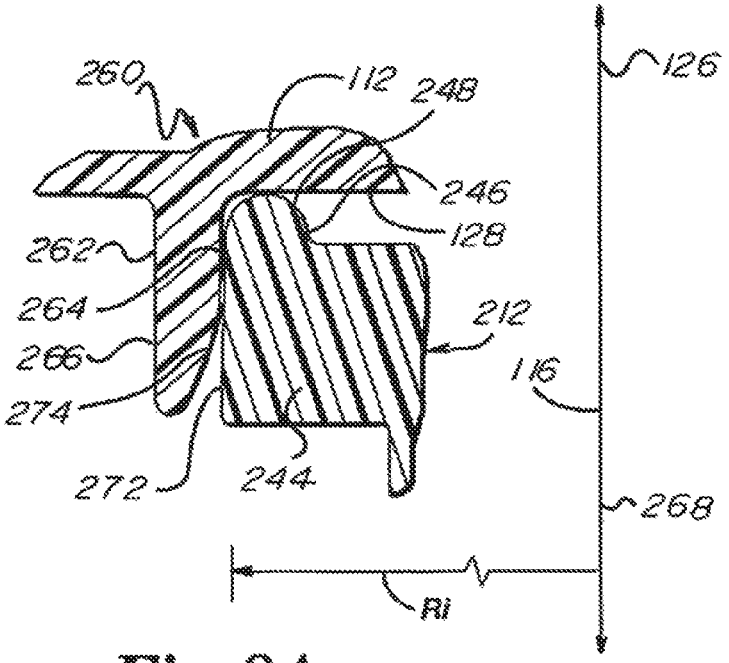
FIG. 8A is an enlarged partial sectional view of the sub-assembly of FIG. 8.

Referring to FIGS. 8 and 8A, a breakseal 260 is depicted in a subassembly 258 with the fitment 212 in an embodiment of the disclosure. The subassembly 258 includes many aspects and characteristics that are similar to the breakseal 110 and fitment 212 described above, which are indicated with same-numbered numerical references. The depicted breakseal 260 further includes an alignment feature 262. The alignment feature 262 includes an inner surface 264 facing the central axis 116 and an outer surface 266 facing away from the central axis 116. In the depicted embodiment, the alignment feature 262 depends from the outer rim portion 112 on the wetted face 128 of the breakseal 260, extending in a second direction 268 that is opposite the first direction 126. The inner surface 264 is disposed at a radius Ri that is sized to provide a close tolerance or an interference fit with an outer radial face 272 of the flange portion 244 of the fitment 212. In one embodiment, the alignment feature 262 includes a tapered portion 274 that tapers away from the central axis 116 in the second direction 268.

Functionally, the alignment feature 262 provides self-alignment of the breakseal 260 to the fitment 212 when the cap 202 is assembled to the overpack 208 (FIG. 6). As the cap 202 is screwed onto the bottle, the tapered portion 274 of the alignment feature 262 will act as a guide over the body portion 242 (e.g., over the outer radial face 272 of the flange portion 244) of the fitment 212, centering the breakseal 260 over the fitment 212. As the cap 202 is tightened to the overpack 208, the alignment feature 262 may also provide a close tolerance or an interference fit to the fitment 212 which acts as a second seal.

The various breakseal embodiments presented above are depicted and described in the context of so-called "bag-in-bottle" (BIB) or "bag-in-can" (BIC) configurations, such as the NOWPak®, manufactured by Entegris, Inc. Such BIB and BIC configurations are described in more detail in, for example, U.S. Pat. No. 6,206,240, filed Mar. 23, 1999, entitled "Liquid Chemical Dispensing System with Pressurization", assigned to the owner of the present application, the disclosure of which is hereby incorporated herein by reference in its entirety except for express definitions and patent claims contained therein.

Figure 9:
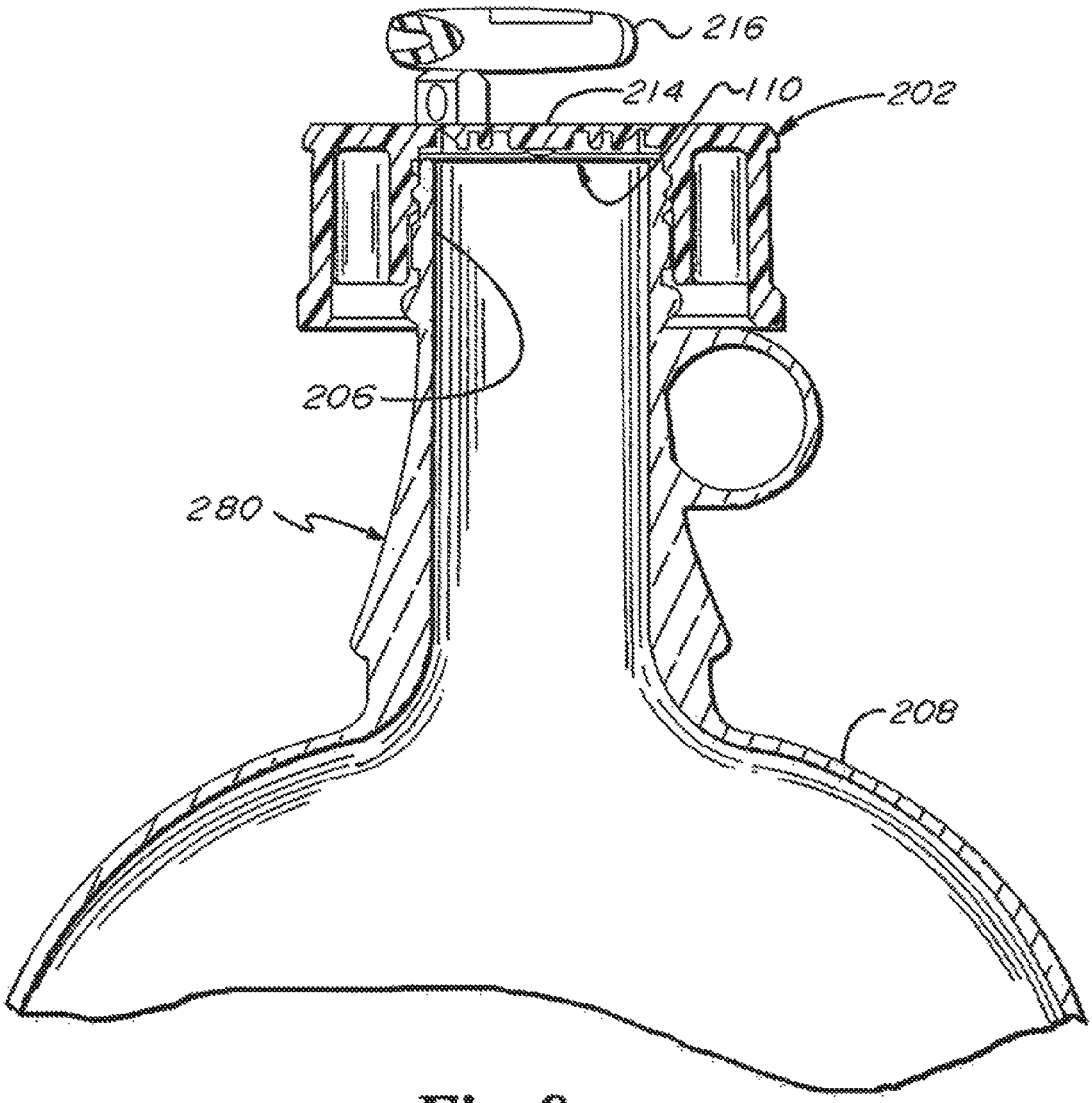
FIG. 9 is a partial sectional view of a cap and traditional glass bottle assembly utilizing the breakseal of FIG. 3 in an embodiment of the disclosure.

The various breakseal embodiments disclosed herein are not limited to BIB or BIC configurations. For example, in certain embodiments, the breakseal 110 is configured for utilization in a traditional glass container 280, such as depicted in FIG. 9 in an embodiment of the disclosure. The breakseal 260 may likewise be configured for application in the traditional glass container 280. The various breakseal embodiments disclosed herein can also be configured a dispensing system 290 utilizing 3D conformal liners and/or rigid collapsible liners, such as the BrightPak® liquid packaging containment, storage and delivery system, manufactured by Entegris, Inc.

Figure 10:
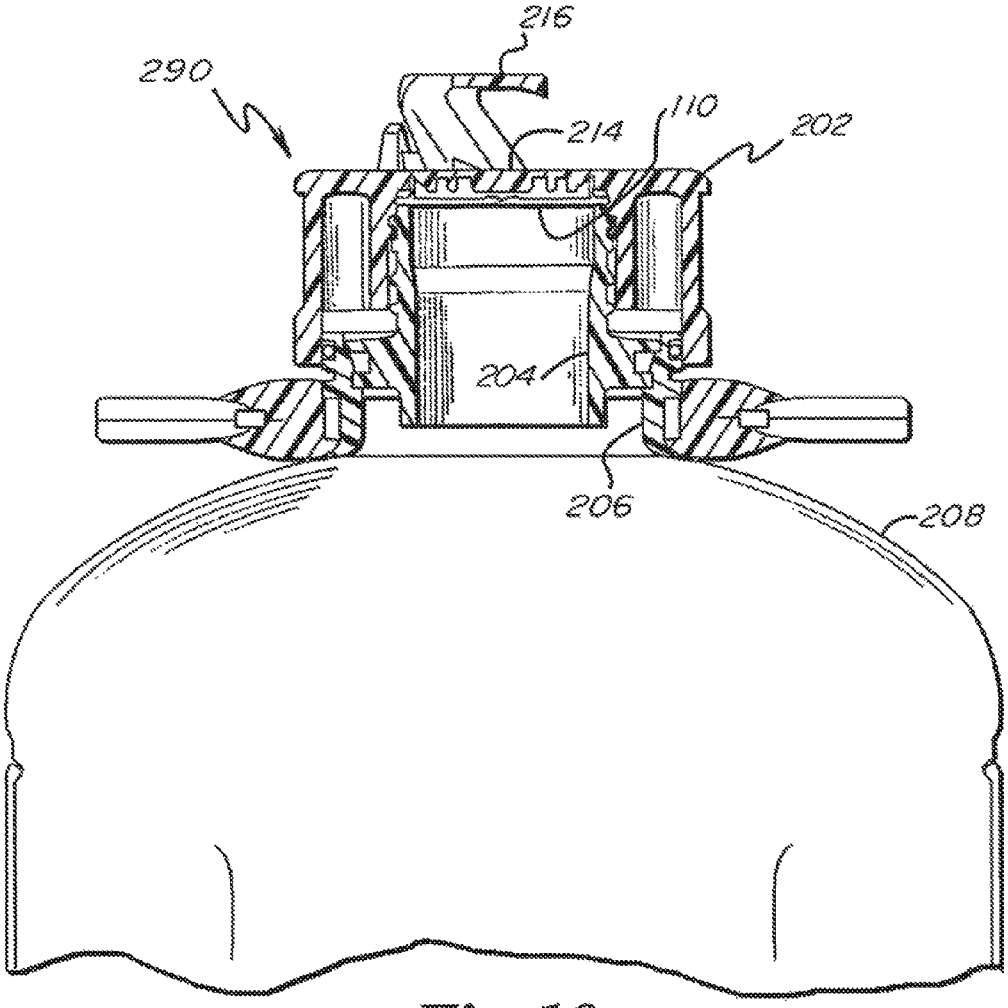
FIG. 10 is a partial sectional view of a cap and container for three dimensional conformal liners utilizing the breakseal of FIG. 3 in an embodiment of the disclosure.

The breakseal 110, depicted in configuration with the dispensing system 290, is depicted in FIG. 10 in an embodiment of the disclosure. The breakseal 260 may likewise be configured for application in the dispensing system 290. Further details of dispensing systems utilizing 3D conformal liners and/or rigid collapsible liners, as well as traditional glass bottles, are depicted and described at International Patent Application No. PCT/US2011/055558, filed Oct. 10, 2011, entitled "Substantially Rigid Collapsible Liner, Container and/or Liner for Replacing Glass Bottles, and Enhanced Flexible Liners", assigned to the owner of the present application and published as International Publication No. WO 2012/051093, the disclosure of which is hereby incorporated herein by reference in its entirety except for express definitions and patent claims contained therein.

Figure 11:
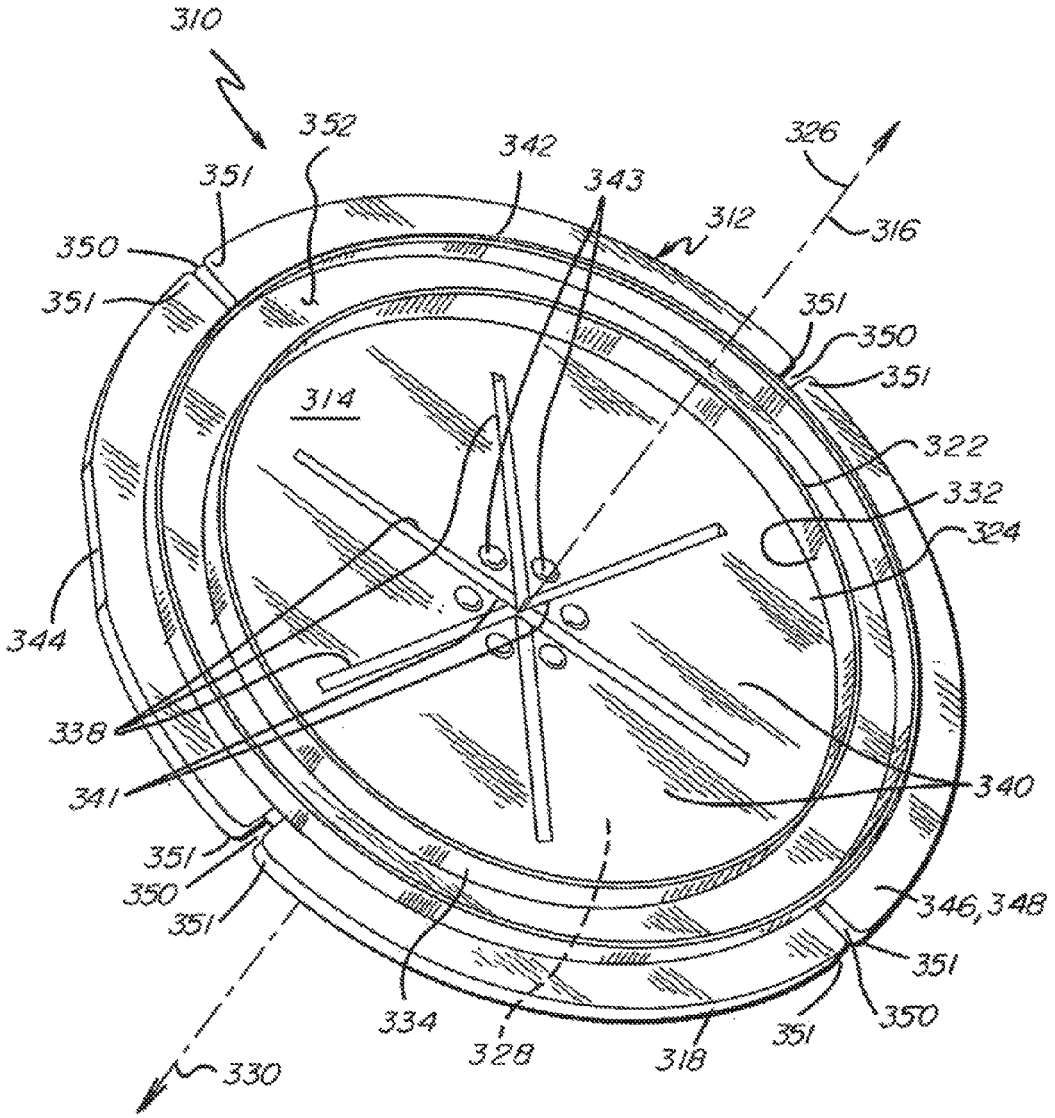
FIG. 11 is a perspective view of a breakseal in an embodiment of the disclosure.
Figure 12:
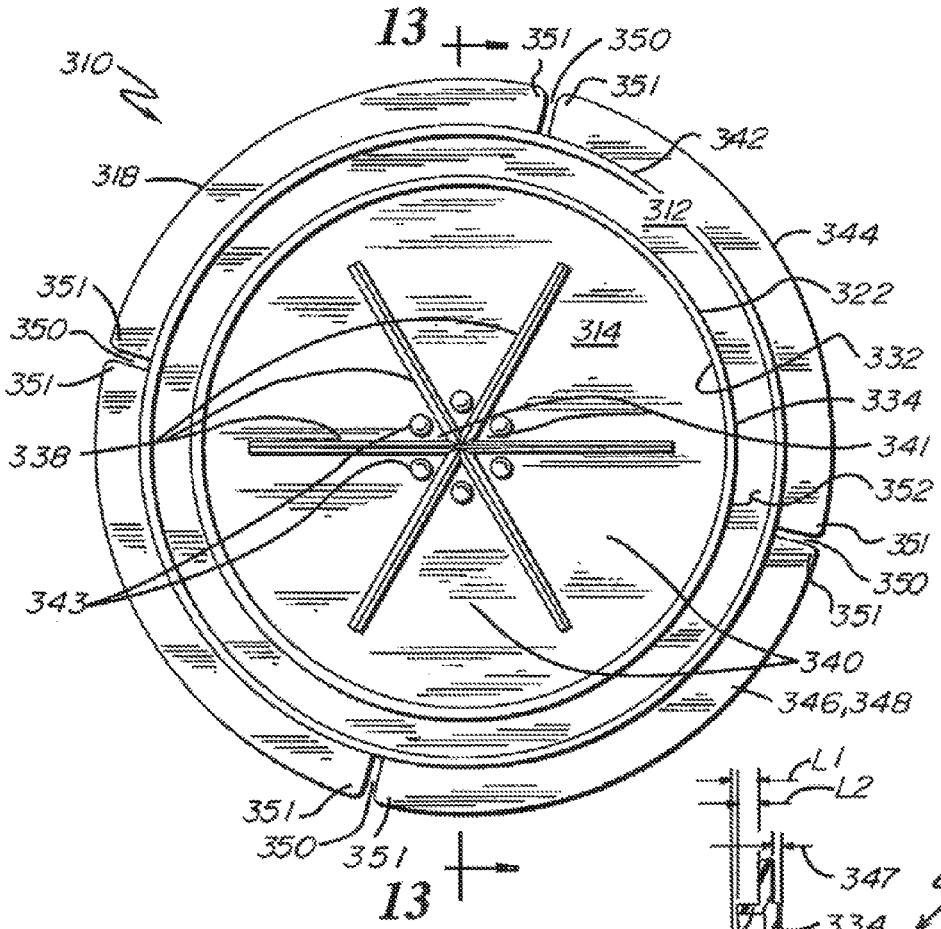
FIG. 12 is a plan view of the breakseal of FIG. 11.
Figure 13:
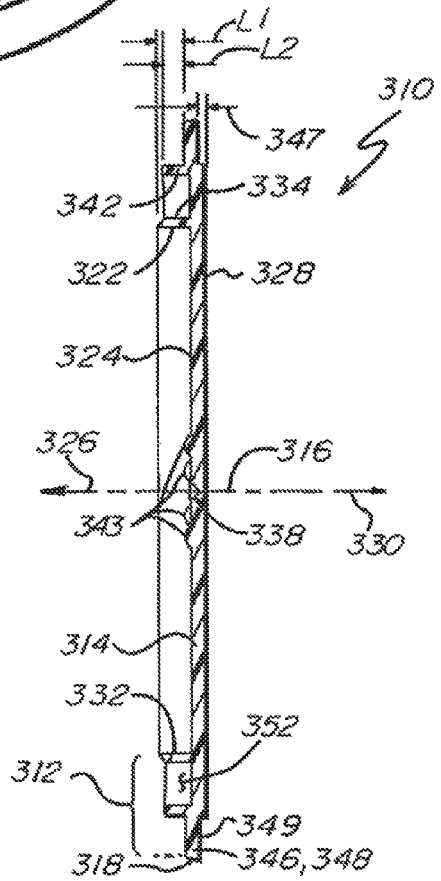
FIG. 13 is a sectional view of the breakseal of FIG. 12.

Referring to FIGS. 11 through 13, a breakseal 310 is depicted in an embodiment of the disclosure. The breakseal 310 includes an outer rim portion 312 and a central seal portion 314, both concentric about a central axis 316. The outer rim portion 312 defines an outer edge 318. An inner rib 322 is disposed at a junction between the outer rim portion 312 and the central seal portion 314, the inner rib 322 extending from a non-wetted face 324 of the breakseal 310 in a first direction 326 that is parallel to the central axis 316. In some embodiments, the inner rib 322 is continuous. The breakseal 310 further includes a wetted face 328 opposite the non-wetted face 324, the wetted face 328 facing in a second direction 330 that is opposite the first direction 326. The inner rib 322 includes an interior surface 332 that faces the central axis 316 and an exterior surface 334 that faces away from the central axis 316. In one embodiment, the breakseal 310 is a molded component formed from perfluoroalkoxy (PFA). The various components of the breakseal 310 may be a single, unitary component (e.g., integrally formed in a molding process).

In various embodiments, a plurality of score lines or score grooves 338 are formed on the non-wetted face 324 to a depth that extends into the central seal portion 314. Each score groove 338 penetrates the thickness of the central seal portion 314 to define a minimum thickness (akin to L3 of FIG. 5) of the central seal portion 314, the minimum thickness being defined between the depth extremity of the score groove 338 and the opposing face (e.g., the wetted face 328 of FIG. 13). The minimum thickness of the central seal portion 314 is configured to rupture generally uniformly along the score grooves 338 on application of a force or pressure thereon that is above a predetermined threshold. In some embodiments, the plurality of score grooves 338 intersect at the central axis 316.

In various embodiments, the central seal portion 314 has a nominal thickness in the range of 0.5 mm to 1.0 mm inclusive; in some embodiments, the nominal thickness of the central seal portion 314 is in the range of 0.5 mm to 0.8 mm inclusive; in some embodiments, the nominal thickness of the central seal portion 314 is in the range of 0.55 mm to 0.7 mm inclusive; in some embodiments, the nominal thickness of the central seal portion 314 is in the range of 0.58 mm to 0.66 mm inclusive.

In some embodiments, the score grooves 338 are formed to define the minimum thickness L3 in the range of 0.1 mm to 0.7 mm inclusive; in some embodiments, the score grooves 338 are formed to define the minimum thickness L3 in the range of 0.1 mm to 0.4 mm inclusive; in some embodiments, the score grooves 338 are formed to define the minimum thickness L3 in the range of 0.12 mm to 0.25 mm inclusive. In some embodiments, the central seal portion 314 is configured to rupture generally uniformly on application of a force thereon in the range of 15 Newtons (N) to 70 N inclusive.

In various embodiments, the breakseal 310 includes a plurality of raised features 343 disposed on the non-wetted face 324. In one embodiment, each of the plurality of raised features 343 is disposed on a corresponding one of the pie-shaped segments 340 proximate the respective apex 341. The breakseal 310 may further comprise an outer rib 342 disposed on the outer rim portion 312 of the breakseal 310 intermediate the inner rib 322 and the outer edge 318. In some embodiments, the outer rib 342 is continuous and surrounds the inner rib 322. The inner and outer ribs 322, 342 extend from the non-wetted face 324 of the breakseal 310 in the first direction 326 parallel to the central axis 316 to define a continuous annular channel 352 therebetween on the non-wetted face 324. In one embodiment, the inner rib 322 extends further in the first direction 326 than the outer rib 342. That is, an axial length L1 of the inner rib 322 may be greater than the axial length L2 of the outer rib 342, where "axial length" is defined a dimension that is parallel to the central axis 316.

In various embodiments, the breakseal 310 defines a flexible centering structure 346 such as a flexible outer flange 348 that extends radially beyond the outer rib 342 to the outer edge 318. In one embodiment, the flexible centering structure 346 defines an axial offset 347 between the wetted face 328 and an offset surface 349 of the flexible centering structure 346 that faces in the second direction 330. By this arrangement, the flexible centering structure 346 extends radially outward from the outer rib 342. In one embodiment, the flexible centering structure 346 defines a plurality of relief slots 350, each extending radially inward from the outer edge 318. The flexible centering structure 346 may include radiused or chamfered corners 351 adjacent the relief slots 350. In various embodiments, a nominal axial thickness (i.e., the thickness between the wetted face 328 and the non-wetted face 324) of both the outer rim portion 312 and the central seal portion 314 are substantially the same thickness. In some embodiments, the radial thickness of the inner and outer ribs 322 and 342 are substantially the same as the nominal axial thickness of the central seal portion 314 and/or the outer rim portion 312.

Figure 14:
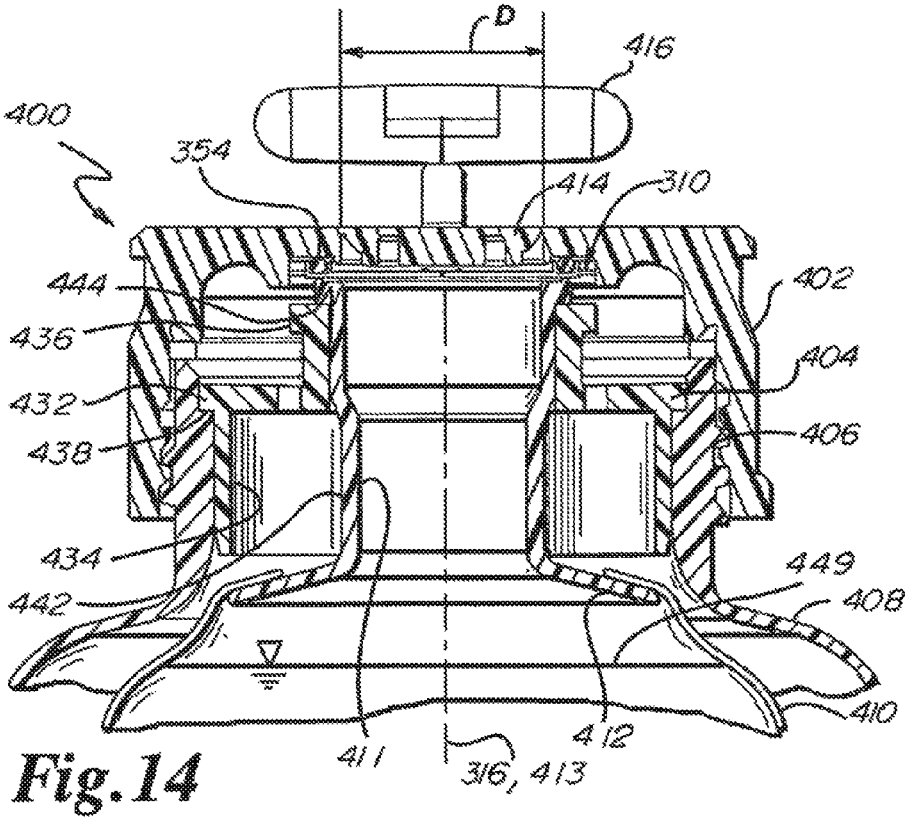
FIG. 14 is a partial sectional view of a cap and bottle assembly utilizing the breakseal of FIG. 11 in an embodiment of the disclosure.
Figure 15:
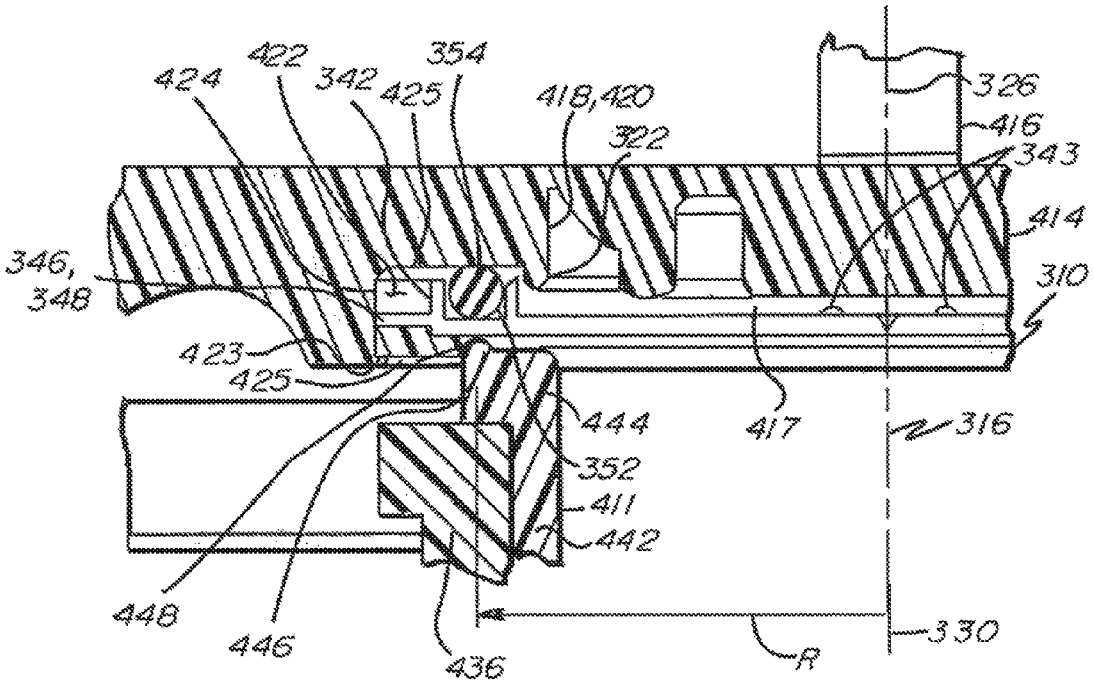
FIG. 15 is an enlarged, partial sectional view of the cap and bottle assembly of FIG. 14.

In various embodiments, the continuous annular channel 352 is configured to accommodate a compliant material 354 (FIGS. 14 and 15). The compliant material 354 comprises a non-shedding material (i.e., resists particle generation under friction) that is compatible with the liquids being dispensed through the breakseal 310. In various embodiments, such compatible, non-shedding materials include ethylene propylene diene monomer (EPDM) or a perfluoroelastomer polymer such as CHEMRAZ® or KALREZ®. In various embodiments, the compliant material 354 is in the form of a compliant member, such as an O-ring (FIG. 15) or gasket. In some embodiments, the compliant material 354 may be composed of a loose material packed into the annular channel 352, such as a packing.

Referring to FIGS. 14 and 15, a cap assembly 400 utilizing the breakseal 310 is depicted in an embodiment of the disclosure. The cap assembly 400 includes a cap 402 and may also include a retainer 404 mounted to a neck portion 406 of an overpack 408, such as a bottle or canister. In some embodiments, a fitment 412 that provides access to, for example, a liner 410, is disposed in the retainer 404 and captured by the cap 402. The fitment 412 defines an access port 411 concentric about a port axis 413. In assembly, the central axis 316 of the breakseal 310 and the port axis 413 of the fitment 412 are in substantial alignment, and the cap 402, retainer 404, neck portion 406, and fitment 412 are substantially concentric about the axes 316 and 413.

In some embodiments, the cap 402 includes a tear tab 414 and handle 416, the tear tab 414 and breakseal 310 defining tear tab cavity 417 therebetween. The cap 402 may further define a throat portion 418 having an inner wall 420 that defines an inner diameter D, the throat portion 418 being blocked off by the tear tab 414. The cap 402 may also define a recess 422 that encircles the throat portion 418, the recess 422 being partially defined by an outer wall 424 and a top face 425. In various embodiments, a lip 423 is disposed at a mouth 425 of the recess 422. The lip 423 may be of one or more discontinuous segments, or be continuous. In one embodiment, the recess 422 is an annular recess.

Also, in addition to or in the alternative, the outer rim portion 312 of the flexible centering structure 346 of the breakseal 310 may be dimensioned to engage the outer wall 424 with a light interference fit. In a "light interference fit," the outer rim portion 312 is oversized relative to the outer wall 424 (e.g., has a larger diameter than the outer wall 424) so that the outer rim portion 312 fits within the outer wall 424 of the recess 422 with enough friction to temporarily hold the breakseal 310 in place while still enabling the breakseal 310 to be slid further into the recess 422 during an assembly process. Non-limiting examples of such oversizing for a light interference fit may be in the range of 0.0175 inches to 0.025 inches inclusive. The light interference fit may be sufficient to retain the breakseal 310 within the cap 402, and may be provided in addition to the lip 423 as a way to retain the breakseal 310.

In one embodiment, the retainer 404 includes a flange portion 432 having a skirt portion 434 that extends into the neck portion 406 of the overpack 408 and a collar portion 436 that extends out of the neck portion 406. The flange portion 432 extends radially from the central axis 316 beyond the skirt portion 434 and rests on an internal shoulder 438 formed in the neck portion 406 of the overpack 408.

In various embodiments, the fitment 412 includes a body portion 442 and a flange portion 444 that extends radially outward from the body portion 442. The body portion 442 is disposed within and extends through the collar portion 436, with the flange portion 444 of the fitment 412 being engaged with the collar portion 436 and being situated between the collar portion 436 and the cap 402. In one embodiment, the flange portion 444 of the fitment 412 includes a continuous raised face 446 that extends from the body portion 442 (e.g., the flange portion 444) in the first direction 326 parallel to the central axis 316. The raised face 446 may be configured to define a radiused profile 448. In one embodiment, the raised face 446 is centered at a contact radius R from the central axis 316 that is located between the inner and outer ribs 322 and 342; that is, the raised face 446 is in radial alignment with the continuous annular channel 352, such that the radiused face 446 is in contact with the segment of the outer rim portion 312 of the wetted face 328 that defines the annular channel 352. Other profiles besides the radiused profile 448 may be implemented, such as polygonal (e.g., triangular) profiles.

In assembly, the retainer 404 and fitment 412 are disposed in the neck portion 406 of the overpack 408, with the flange portion 432 of the retainer 404 seated on the internal shoulder 438 of the neck portion 406. The compliant material 354 is loaded into the continuous annular channel 352 of the breakseal 310, and the loaded breakseal 310 disposed in the cap 402 so that the outer rim portion 312 is coupled to the outer wall 424 with the recess 422. As discussed above, this coupling may be made with a light interference fit. After implementation of a supply process (e.g., filling of the liner 410 attached to the fitment 412 with a liquid 449), the cap 402, with the breakseal 310 installed therein, is coupled to the neck portion 406 of the overpack 408 so that the wetted face 328 of the breakseal 310 is brought into contact with the raised face 446 of the fitment 412. The cap 402 is then secured to the neck portion 406 so that the raised face 446 contacts and exerts an upward force on the breakseal 310, causing the breakseal 310 to translate further upwards into the recess 422. As the cap 402 is tightened onto the neck portion 406, the compliant material 354, carried upwards within the recess 422 by the breakseal 310, contacts the top face 425 of the recess 422. As the cap 402 is further tightened, the compliant material 354 is compressed between the breakseal 310 and the top face 425 of the recess 422, thereby exerting a compression force between the raised face 446 of the fitment 412 and the breakseal 310. In one embodiment, securing of the cap 402 to the neck portion 406 is accomplished by threaded engagement, and the compression force is accomplished by rotating (torquing) the cap 402 onto the neck portion 406.

Functionally, the flexible centering structure 346 enables the breakseal 310 to be slid into place during seating of the breakseal 310 without binding up within the recess 422, even if the breakseal 310 is not in perfect or near-perfect alignment within the recess 422. The flexibility of the flexible centering structure 346 enables local deformation in response to local "grabbing" between the outer wall 424 and the flexible centering structure 346, thus enabling the breakseal 310 to continue sliding and to become self-aligned within the recess 422. Furthermore, the thickness dimensions that produce the desired flexibility characteristics of the flexible centering structure 346 is of limited thickness, thus reducing the bearing interaction between the flexible centering structure 346 and the recess 422 that would otherwise require more careful alignment. Non-limiting examples of thicknesses (i.e., dimension in the axial direction) for the flexible centering structure 346 is in the range of 0.015 inches to 0.1 inches inclusive. In one embodiment, the range of thickness for the flexible centering structure 346 is from 0.02 inches to 0.075 inches inclusive.

The axial offset 347 may further assist in the assembly process. For the installation of the breakseal 310 to have a compressive effect when fully seated within the recess 422, the compliant material 354 extends above the inner rib 322 and the outer rib 342. It has been discovered that, for flexible alignment structures that are flush with the wetted face 328 of the breakseal 310, some compression of the compliant material 354 against the top face 425 of the recess 422 was required during initial insertion of the breakseal 310 into the recess 422 in order for the flexible alignment structure to fully engage the outer wall 424 of the recess 422. This compression of the compliant material 354 sometimes caused the breakseal 310 to be pushed out of the recess 422, thereby making the initial installation of the breakseal 310 into the recess 422 problematic and tenuous.

By locating the flexible centering structure 346 offset from the wetted face 328, the flexible centering structure 346 readily registers against the outer wall 424 of the recess 422 without need for compressing the compliant material 354 during initial insertion. By eliminating or greatly reducing compression of the compliant material 354, there is no pushback sufficient to unseat the breakseal 310 during initial installation.

The raised face 446 acts as a stress concentrator when breakseal 310 is compressed thereon that acts to deform the breakseal 310 about the radiused profile 448 of the raised face 446. The compliance of the compliant material 354 enables the outer rim portion 312 to deflect and conform to the shape of the raised face 446 while directly increasing a compression force between the breakseal 310 and the raised face 446, thereby affecting a seal between the breakseal 310 and the fitment 412. Also, by this arrangement, the compliant material 354 does not make contact with the contained liquid 249, and thus need not be compatible with the liquid 249.

The flat 344 provides an area for a gate for injection molding. At the flat 344, any gate vestige from the molding process will not protrude beyond the outer diameter of the breakseal 310, and therefore does not cause unwanted interference or misalignment between the breakseal 310 and the cap 402.

Figure 16:
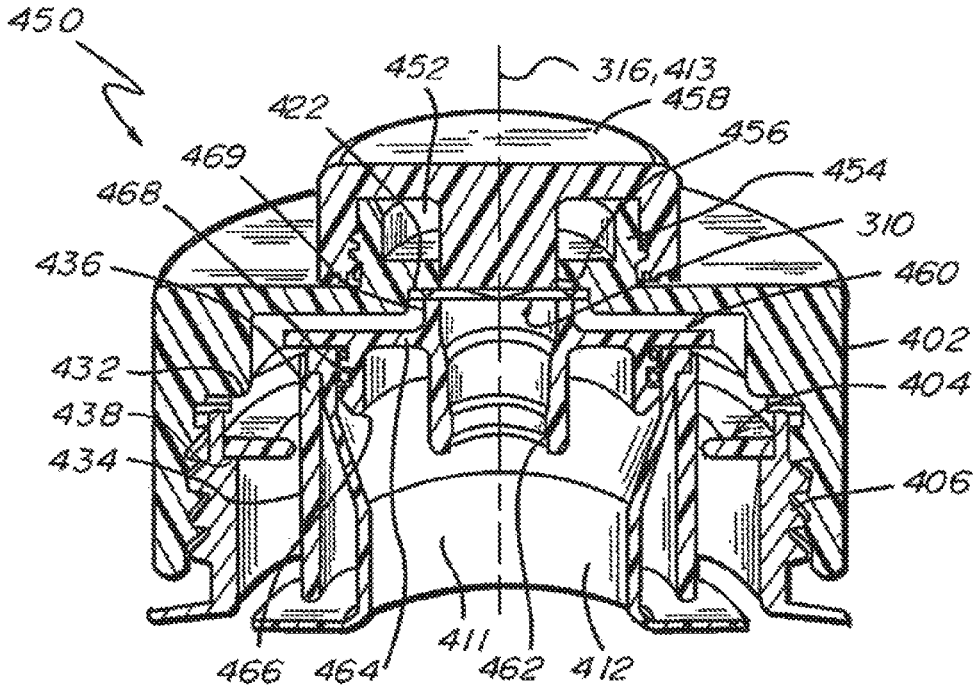
FIG. 16 is a partial sectional view of a cap assembly in an embodiment of the disclosure.

Referring to FIG. 16, an alternative cap assembly 450 is depicted in an embodiment of the disclosure. The cap assembly 450 includes many of the same components and attributes as the cap assembly 400, which are indicated by same-numbered numerical references. The cap 402 of the cap assembly 450 includes a port 452 having a neck 454 and defining an aperture 456. A plug 458 is coupled to the port 452. In the depicted embodiment, the neck 454 and plug 458 include complementary threads for threadable engagement.

In one embodiment, the cap assembly 450 includes an insert 460 for retaining and centering a dip tube or probe (neither being depicted). The insert 460 may include a central body 462, a flange 464, and a centering ring 466. In one embodiment, the centering ring 466 includes an O-ring 468 that provides a seal on an interior surface of the fitment 412.

The central body 462 includes an upper end 469 that engages with the breakseal 310. The upper end 469 may include the same structure as the flange portion 444 of the fitment 412, i.e., a raised face akin to raised face 446 that acts as a stress concentrator when the breakseal 310 is compressed thereon. See the discussion attendant to FIG. 15. The recess 422 of the cap 402 may be configured in the same manner for both cap assemblies 400 and 450 and engage the breakseal 310 in the same way.

Functionally, the plug 458 is removed (instead of a tear tab) to provide access to the breakseal 310. The insert 460 enables use of the breakseal 310 with larger containers.

Figure 17:
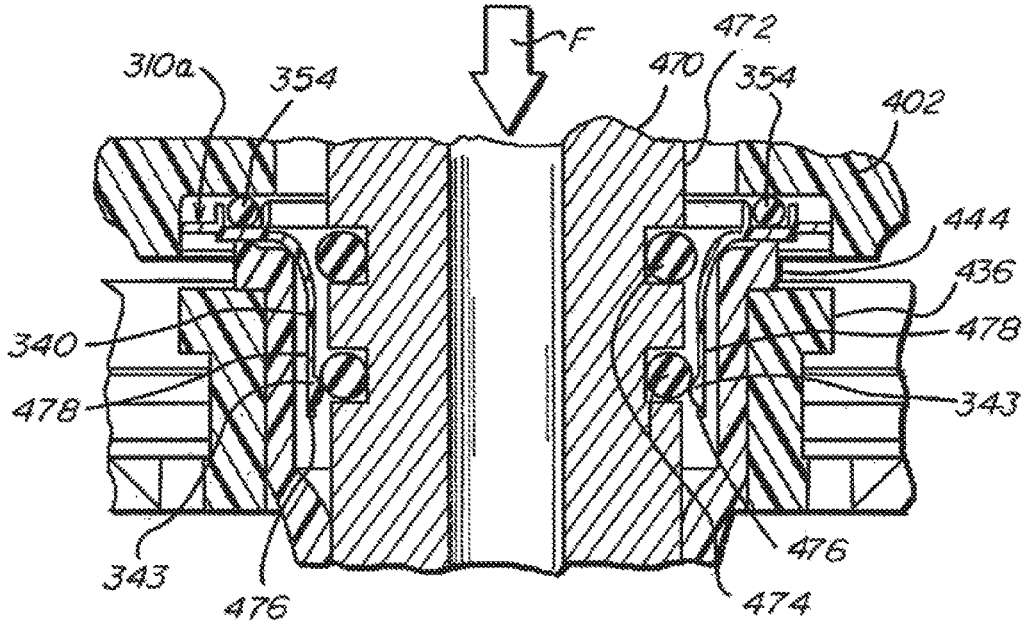
FIG. 17 is a sectional view of a breakseal having raised features in operation during insertion of a probe in an embodiment of the disclosure.

Referring to FIG. 17, operation of the raised features 343 is depicted in an embodiment of the disclosure. A probe 470 having an outer surface 472 and including O-ring seals 474 is depicted as being slid through a ruptured breakseal 310*a*, the rupture being caused by an insertion force F exerted by the probe 470 on the non-wetted face 324 of the ruptured breakseal 310*a*. The pie-shaped segments 340 break away to define points 476 at the apexes 341 (FIG. 11) and exposed edges 478 along the ruptured score grooves 338. The points 476 and exposed edges 478 often present sharp and/or jagged surfaces or features. The resilience of the pie-shaped segments 340 may, in some instances, cause the pie-shaped segments 340 to exert a force against the O-ring seals 474 as the probe 470 passes through the ruptured breakseal 310*a*.

The raised features 343 ride along the probe 470 as it passes by the pie-shaped segments 340, being held against the probe 470 by the resilience of the bend pie-shaped segments. As the O-ring seals 474 pass through the ruptured breakseal 310*a*, the raised features 343 ride over the O-ring seals 474, lifting the points 476 and exposed edges 478 away from the O-ring seals 474. In this way, contact between the O-ring seals 474 and the sharp points 476 and exposed edges 478 is prevented or reduced, greatly reducing the risk of damage to the O-ring seals 474.

Like the breakseals 110 and 260, the breakseal 310 may be configured for application in the traditional glass container 280 of FIG. 9, and/or dispensing systems such as dispensing system 290 utilizing 3D conformal liners and/or rigid collapsible liners (e.g., the BrightPak® liquid packaging containment, storage and delivery system).

Figure 18:
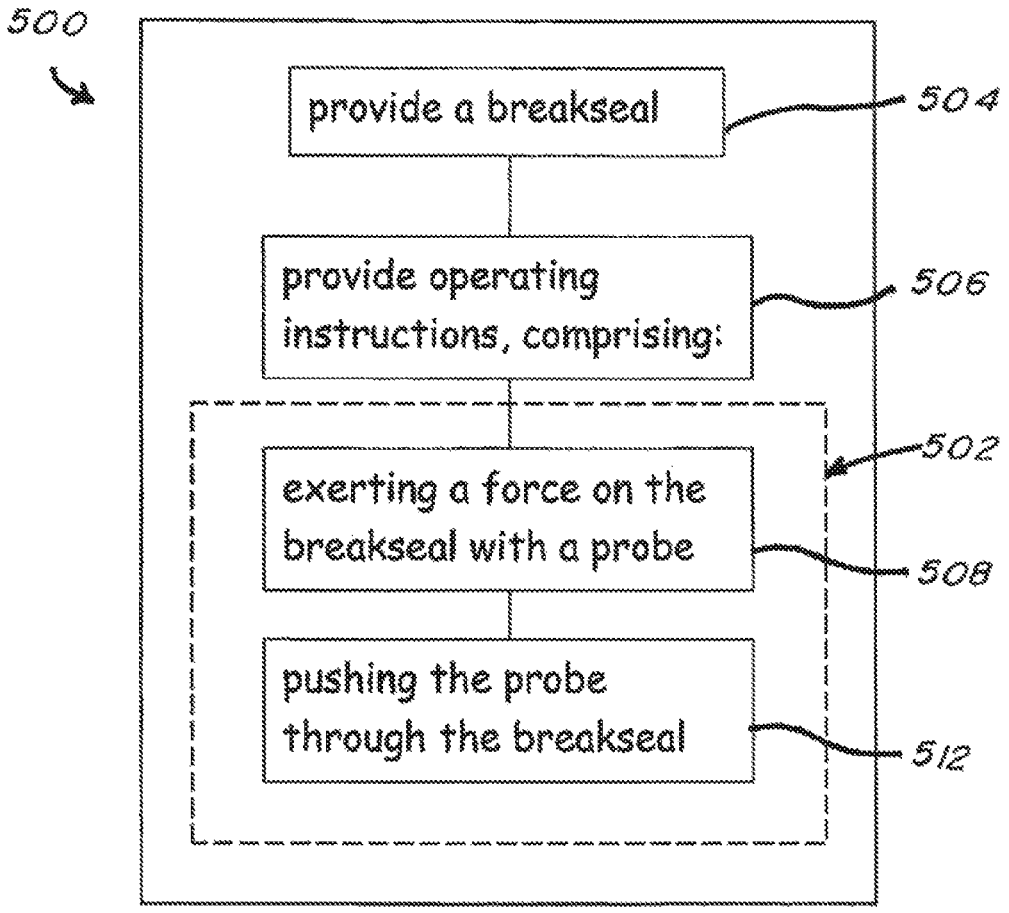
FIG. 18 is a flow chart representation of a method of using a breakseal in an embodiment of the disclosure.

Referring to FIG. 18, instructions 500 for inserting the probe 470 through the breakseal 310 provided on a tangible medium 502 is depicted in an embodiment of the disclosure. The instructions 500 include method steps comprising providing a breakseal (504), providing operating instructions on a tangible medium (506), exerting a force on the breakseal with a probe, causing the breakseal to rupture (508), and pushing the probe through the breakseal (512).

In some embodiments, the tangible medium 502 is one or more of a document, a computer readable storage medium, or other suitable tangible medium. In some embodiments, the computer readable storage medium is a tangible device that retains and stores instructions for use by an instruction execution device.

In some embodiments, the computer readable storage medium includes, but is not limited to, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. In one embodiment, the computer readable storage medium includes a QR code readable using a scanner.

A "tangible medium," as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

In some embodiments, the instructions described herein are downloaded to respective computing/processing devices from a computer readable storage medium or to an external computer or external storage device via a network, such as the Internet, a local area network, a wide area network, and/or a wireless network.

The operating instructions 500 are provided as but one example of a breakseal, either standing alone or in assembly, being provided as a kit or part of a kit that includes operating, installation, and/or manufacturing instructions. Other operational steps and methodologies, as supported by this application, are contemplated as being included in an instruction set provided on a tangible medium.

As disclosed at International Publication No. WO 2012/051093 (incorporated by reference above), example uses of the liners disclosed herein may include, but are not limited to, storage, transport, and/or dispensing of acids, solvents, bases, photoresists, chemicals and materials for OLEDs, such as phosphorescent dopants that emit green light, for example, ink jet inks, slurries, detergents and cleaning formulations, dopants, inorganic, organic, metalorganics, TEOS, and biological solutions, DNA and RNA solvents and reagents, pharmaceuticals, hazardous waste, radioactive chemicals, and nanomaterials, including for example, fullerenes, inorganic nanoparticles, sol-gels, and other ceramics, and liquid crystals, such as but not limited to 4-methoxylbenzylidene-4'-butylaniline (MBBA) or 4-cyanobenzylidene-4'-n-octyloxyanaline (CBOOA). The liners disclosed herein may further be used in other industries and for transporting and dispensing other products such as, but not limited to, coatings, paints, polyurethanes, food, soft drinks, cooking oils, agrochemicals, industrial chemicals, cosmetic chemicals (for example, foundations, bases, and creams), petroleum and lubricants, adhesives (for example, but not limited to epoxies, adhesive epoxies, epoxy and polyurethane coloring pigments, polyurethane cast resins, cyanoacrylate and anaerobic adhesives, reactive synthetic adhesives including, but not limited to, resorcinol, polyurethane, epoxy and/or cyanoacrylate), sealants, health and oral hygiene products, and toiletry products.

Various modifications to the embodiments will be apparent to one of skill in the art by virtue of reading this disclosure. Persons of ordinary skill in the relevant art will recognize that the various features described for the different embodiments can be suitably combined, un-combined, and re-combined with other features, alone, or in different combinations. For example, it is contemplated that the flexible centering structure 346, the inner circular rib 122 and attendant wiping feature, and the raised features 343 could be combined in a breakseal, even though such combination is not presented in the drawings or otherwise discussed as a single embodiment. Ergo, the disclosed embodiments should all be regarded as examples, rather than limitations to the scope or spirit of the disclosure.

International Application No. PCT/US2013/066746, published as International Publication No. WO 2014/066723, owned by the applicant of the present application and also directed to breakseal technology, is hereby incorporated by reference herein except for express definitions and claims included therein.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A molded breakseal comprising:

an outer rim portion and a central seal portion, both concentric about a central axis, said outer rim portion defining an outer edge;

an inner circular rib disposed at a junction between said outer rim portion and said central seal portion, said inner circular rib extending from a non-wetted face of said breakseal in a first direction parallel to said central axis, said inner circular rib including an interior surface facing said central axis and an exterior surface facing away from said central axis; and a plurality of score grooves defining an axial depth into said central seal portion, such that the central seal portion is configured to rupture generally uniformly on application of a force thereon above a predetermined threshold force.

2. The molded breakseal of claim 1, comprising an outer rib extending from said outer edge of said breakseal in said first direction parallel to said central axis.

3. The molded breakseal of claim 2, wherein said outer rib is continuous.

4. The molded breakseal of claim 3, wherein said outer rib defines a flat over a portion thereof.

5. The molded breakseal of claim 1, comprising at least one circular intermediate rib concentric about said central axis and disposed radially outward from said inner circular rib and radially inward from said outer edge, said at least one circular intermediate rib extending from said non-wetted face of said breakseal in said first direction parallel to said central axis.

6. The molded breakseal of claim 5, wherein said inner circular rib extends further in said first direction parallel to said central axis than said at least one circular intermediate rib.

7. The molded breakseal of claim 5, wherein said at least one circular intermediate rib comprises a first intermediate rib and a second intermediate rib, said second intermediate rib being disposed radially outward from said first intermediate rib to define a channel therebetween on said non-wetted face.

8. The molded breakseal of claim 7, wherein said first intermediate rib, said second intermediate rib, and said channel are continuous.

9. The molded breakseal of claim 7, further comprising a compliant material disposed in said channel.

10. The molded breakseal of claim 8, wherein said compliant material is an O-ring.

11. The molded breakseal of claim 9, wherein said compliant material is one of a perfluoroelastomer polymer and an ethylene propylene diene monomer.

12. The molded breakseal of claim 1, wherein said breakseal is formed from perfluoroalkoxy (PFA).

13. A container system, comprising:

a fitment including a body portion defining an access port and having a continuous raised face concentric about a port axis of said access port;

a molded breakseal, comprising:

an outer rim portion and a central seal portion, both concentric about a central axis, said outer rim portion defining an outer edge;

an inner circular rib disposed at a junction between said outer rim portion and said central seal portion, said inner circular rib extending from a non-wetted face of said breakseal in a first direction parallel to said central axis;

an outer circular rib disposed at said outer rim portion and extending from said non-wetted face of said breakseal in said first direction parallel to said central axis, wherein said inner circular rib, said outer circular rib, and said outer rim portion cooperate to define a channel; and a plurality of score grooves formed on said central seal portion;

wherein said central axis of said molded breakseal is in substantial alignment with said port axis of said access port, said raised face defining a contact radius that contacts a wetted face of said molded breakseal in alignment with the continuous annular channel; and a compliant material disposed in said channel of said molded breakseal.

14. The container system of claim 13, comprising a liner attached to said fitment.

15. The container system of claim 14, wherein said liner is configured to contain a photoresist.

16. The container system of claim 13, comprising an overpack including a neck portion defining an opening, said fitment being disposed in said neck portion.

17. The container system of claim 16, comprising a cap detachably coupled to said neck portion, said cap securing said molded breakseal.

18. The container system of claim 17, wherein:

said outer rim portion of said molded breakseal defines a flexible centering structure that extends radially beyond said outer circular rib to said outer edge;

said cap defines a recess having an outer wall, said outer wall being sized to accommodate the outer rim portion of said flexible centering structure with a light interference fit.

19. The container system of claim 18, wherein said cap includes a tear tab.

20. The container system of claim 13, comprising a plurality of raised features on said non-wetted face of said breakseal proximate said score grooves.

* * * * *